US005996970A

United States Patent [19]

Auerbach

[11] Patent Number: 5,996,970

[45] Date of Patent: Dec. 7, 1999

[54] MOTORIZED ASSIST COUNTERWEIGHT SYSTEM FOR THEATRICAL OVERHEAD RIGGING

[76] Inventor: S. Leonard Auerbach, 3349 Pierce St., San Francisco, Calif. 94123

[21] Appl. No.: 09/104,554

[22] Filed: Jun. 25, 1998

[51] Int. Cl.[6] ..... B66D 1/26

[52] U.S. Cl. ..... 254/288; 254/280; 254/290; 254/393; 160/332; 472/78

[58] Field of Search ..... 254/275, 280, 254/282, 288, 289, 290, 372, 393, 397; 472/77, 78, 79, 80; 160/331, 332

[56] References Cited

U.S. PATENT DOCUMENTS

| | | | |
|---|---|---|---|
| 1,027,028 | 5/1912 | Bailey | 472/78 |
| 1,810,890 | 6/1931 | Allen | 472/78 |
| 3,345,066 | 10/1967 | Izenour | 472/78 |
| 3,370,639 | 2/1968 | Von Brimer | 160/331 |
| 3,429,298 | 2/1969 | Thomason | 160/331 |
| 3,986,703 | 10/1976 | Brett et al. | 472/78 |
| 4,606,527 | 8/1986 | Ziller et al. | 472/78 |
| 5,031,574 | 7/1991 | Mcdowell | 160/331 X |
| 5,790,407 | 8/1998 | Strickland et al. | 254/280 X |

FOREIGN PATENT DOCUMENTS

| | | | |
|---|---|---|---|
| 1133524 | 6/1960 | Germany | 254/275 |

*Primary Examiner*—Donald P. Walsh
*Assistant Examiner*—Emmanuel M. Marcelo
*Attorney, Agent, or Firm*—Majestic, Parsons, Siebert & Hsue P.C.

[57] ABSTRACT

In a theatrical rigging system, a number of motors can be placed on platforms which can move upon rails to be connected to different theatrical rigging elements. The motors can be randomly attached to operate different overhead hanging devices.

21 Claims, 4 Drawing Sheets

MOTORIZED ASSIST COUNTERWEIGHT SYSTEM FOR THEATRICAL OVERHEAD RIGGING

FIELD OF THE INVENTION

The present invention relates to an apparatus for motorizing overhead rigging line sets for theaters.

BACKGROUND OF THE INVENTION

In many theaters scenery is raised and lowered over the stage on wire rope (cables). The movable scenery can be changed in between scenes as required by the theatrical presentation. Most modern rigging line set systems are counterweight systems in which the weight of the scenery is balanced by counterweights. Stage hands can manually lower and raise the scenery by pulling on a cord attached to the counterweight.

Alternately, a control chain can be attached to the counterweight and the control chain connected to a motor. In this way, the motor can then control the raising and the lowering of the scenery. An example of such a system is described in R. A. Drew U.S. Pat. No. 3,165,296.

It is desired to have an improved system for positioning overhead scenery.

SUMMARY OF THE PRESENT INVENTION

Large modern stages can have a great number of line sets. If each of the line sets were to have its own motor, the required space and cost could be prohibitive. However, the use of the motor is especially desirable in modern theater designs because it facilitates the computer control of the rigging line sets.

The present invention is a system in which motors are moved manually between different rigging line sets as needed. The motors can be attached to a control chain of a rigging element so that the motor can control the raising and lowering of the scenery. In one embodiment, the motors are mounted on platforms. The platform sits on a rail and can be pushed between different rigging element areas to align with a selected line set.

DETAILED DESCRIPTION OF THE PREFERRED EMBODIMENT

Figure 1:
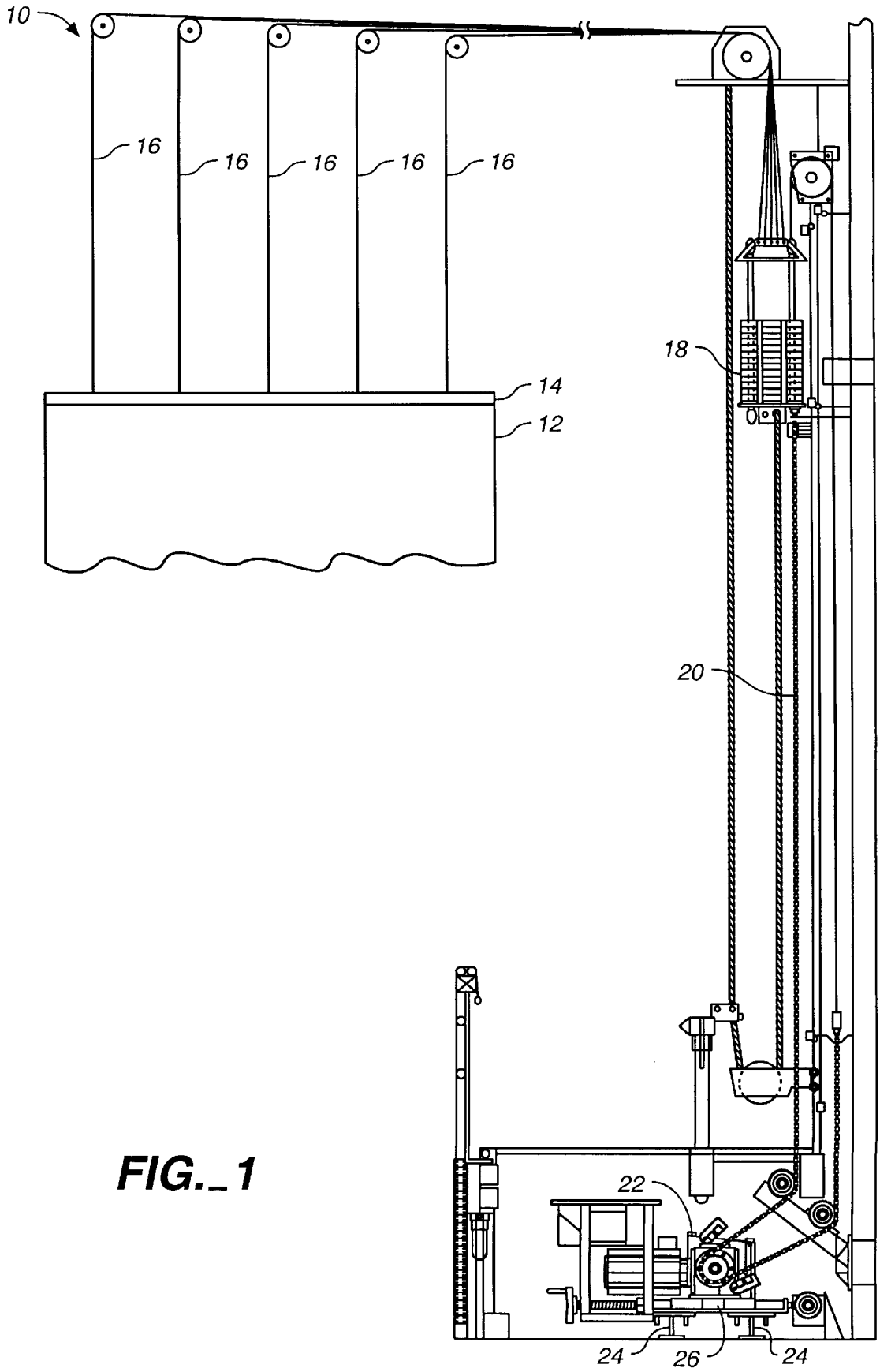
FIG. 1 is a diagram illustrating the counterweight system of the present invention for controlling stage weight.

FIG. 1 is a diagram that illustrates the rigging system 10 of the present invention. Scenery 12 is connected to support bar 14. Wires 16 connect the scenery to the counterweight 18. The counterweight 18 is adjusted with the removable weights so as to match the weight of the scenery. A control chain 20 is connected to the bottom of the counterweight 18. The control chain 20 is such that a given length of the control chain 20 matches the total weight of the same length of the wires 16. This aids in the balancing of the scenery at different positions. As described in the present invention, the motor 22, mounted on platform 26, can be moved along the rails 24 in between different rigging elements.

Figure 2A:
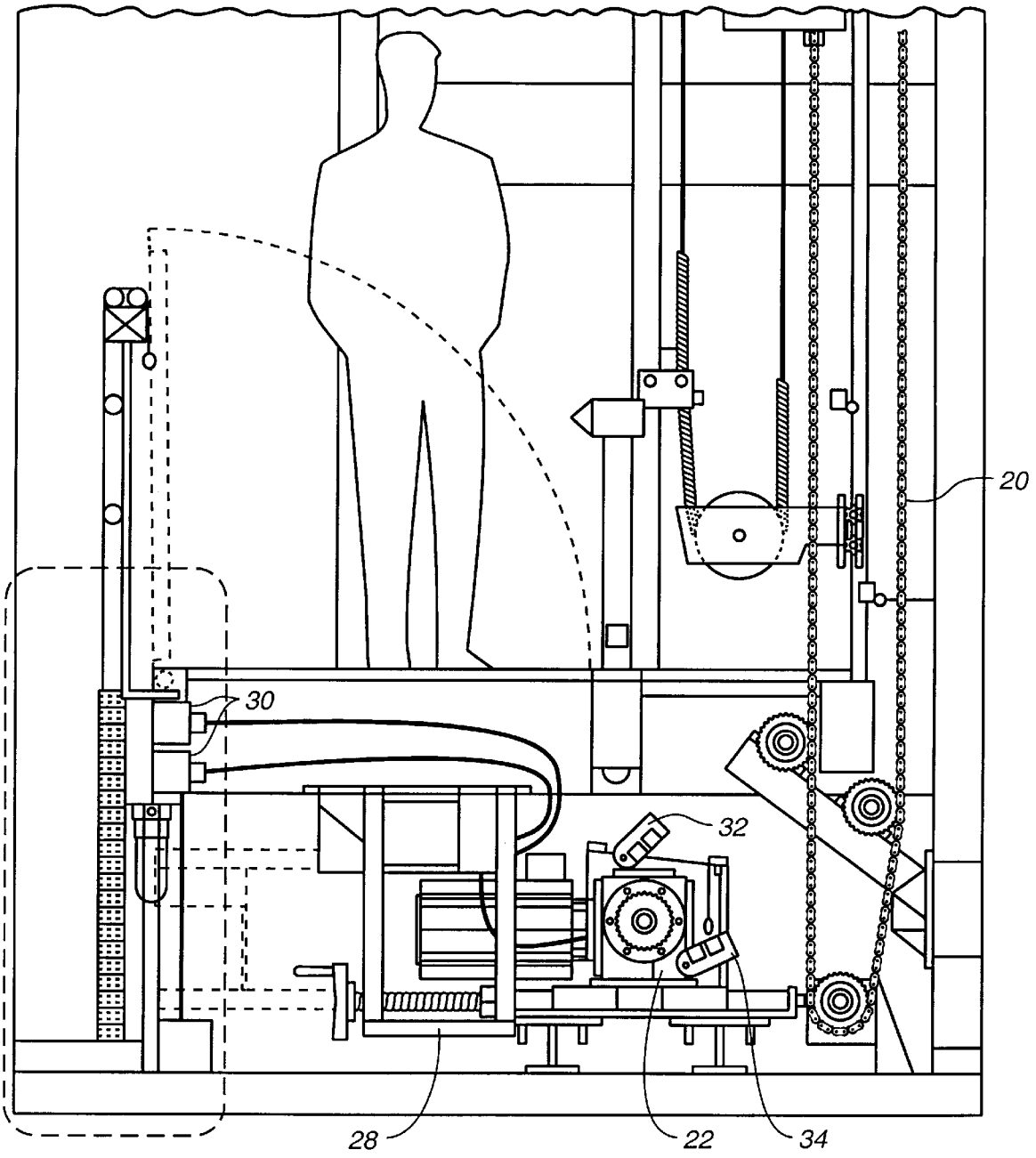
FIGS. 2A and 2B are diagrams illustrating the attachment of the control chain to the motor.
Figure 2B:
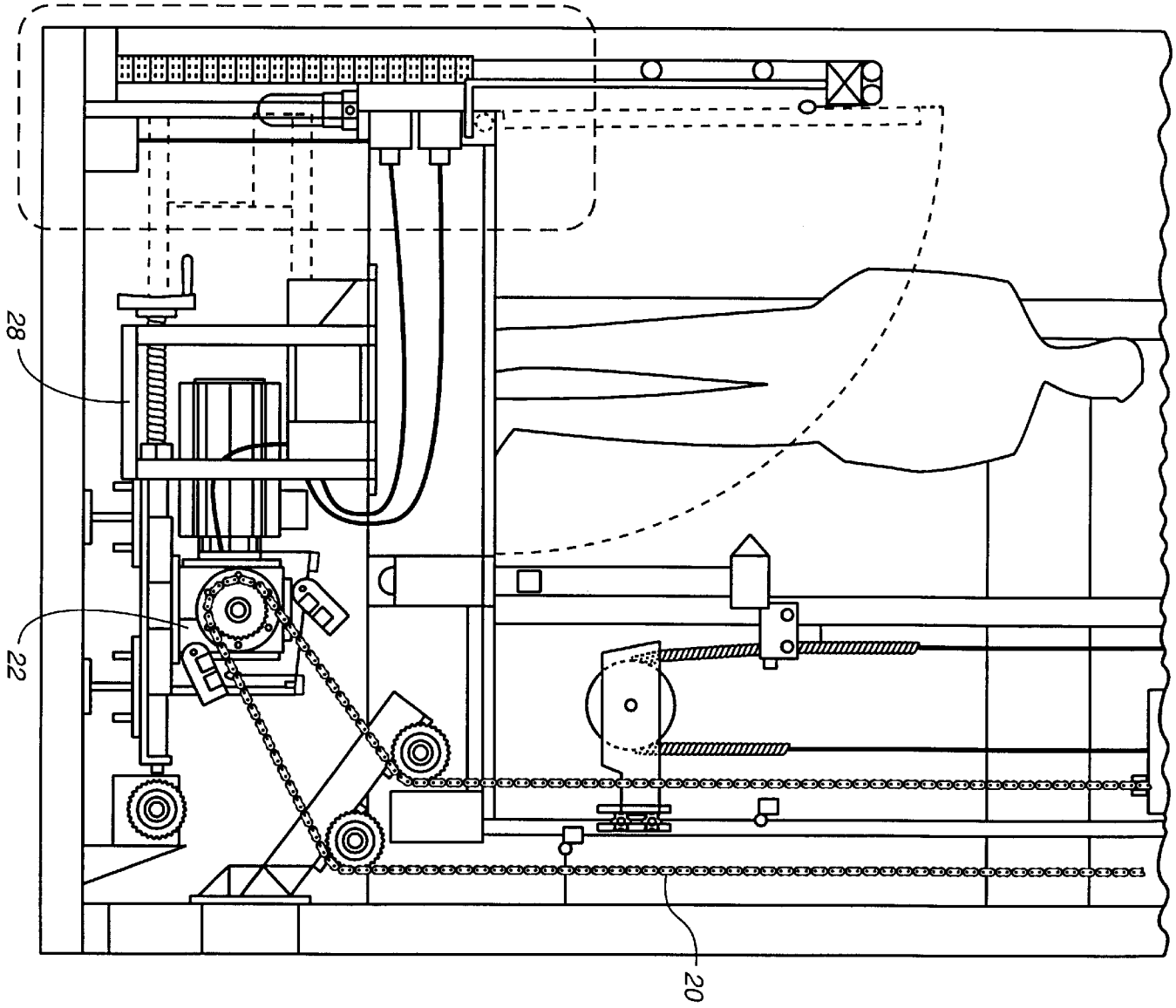

FIGS. 2A and 2B illustrate how the control chain can be connected to the motor. As shown in FIG. 2A, the motor 22 is mounted on a carriage 28 which allows the control chain 20 to be attached to the drive sprocket and tensioned. The motor 22 is connected to the power and control receptacles 30. The hookups allow for the powering of the motor and for the automatic computer control of the motors once attached.

In the preferred embodiment, the hoist motor can carry a working load at a variable speed.

The system has a down limit switch 32 and an up limit switch 34. The limit switches limit the full range of the motor's movement so that the rigging elements are always within the desired range of positions.

As shown in FIGS. 2A and 2B, the motor can be cranked so that the sprocket engages the control chain 20 and then can be tensioned back into the operative position. In this position, the motor can drive the counterweight arbor in the up or down directions to control the positioning of the scenery.

Figure 3:
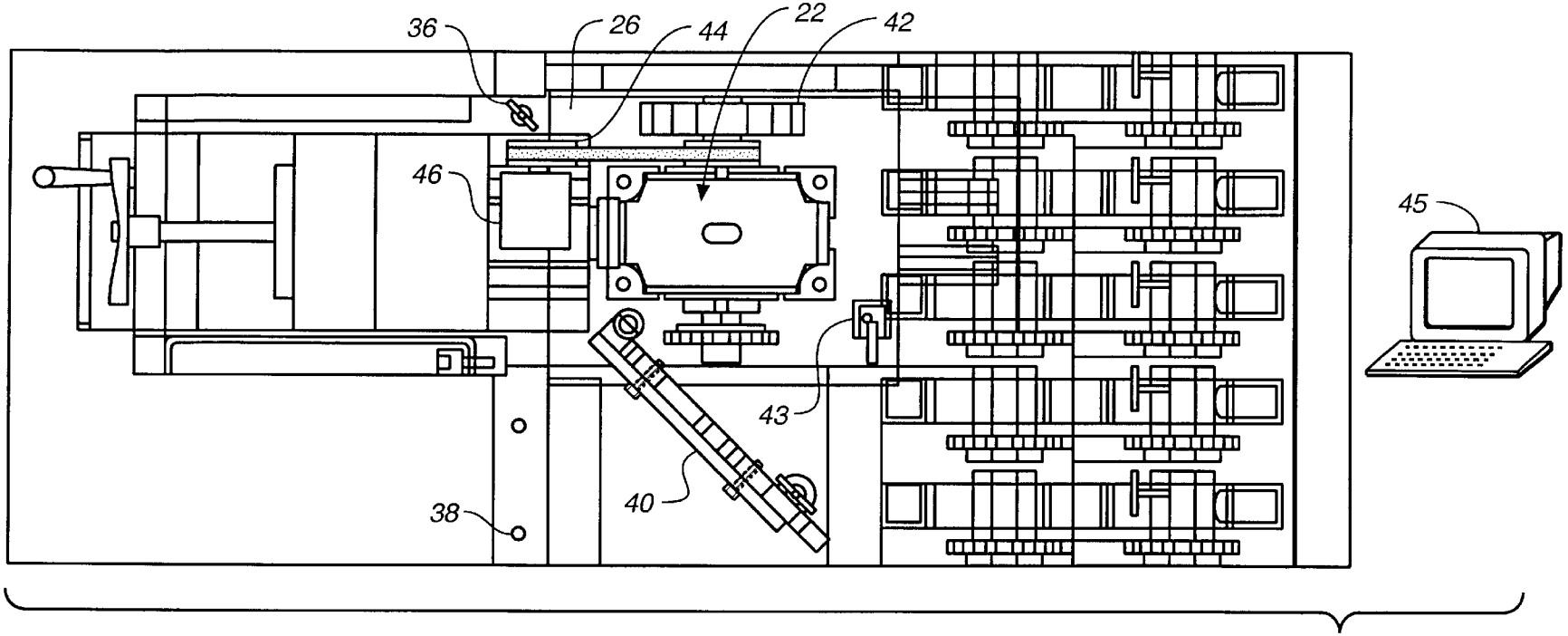
FIG. 3 is a top view illustrating the positioning of the motor at the different line set areas.

FIG. 3 is a top view of the motor and some of the gear elements for this theatrical rigging. As shown in this top view, the theatrical rigging elements can be closely spaced together so as to allow for a large number of rigging elements to be provided within a small backstage space. The motor 22 is positioned in-line with the control chain of the theatrical rigging device. The position alignment lock pin 36 on the platform 26 ensures that the elements are lined up. The pin drops into position holes such as position hole 30*a* in the rail. A swing-away chain guard 40 can close around the chain once it is positioned on to the motor. The chain guard 40 connects to a microswitch 43 that disables the operation of the device unless the chain guard is positioned correctly. The motor includes an overspeed brake 42. The positioning encoder 46 is connected to the cogbelt 44 and is used to produce an indication of the position of the control chain and thus the scenery. This data is sent to the computer control system 45.

Figure 4:
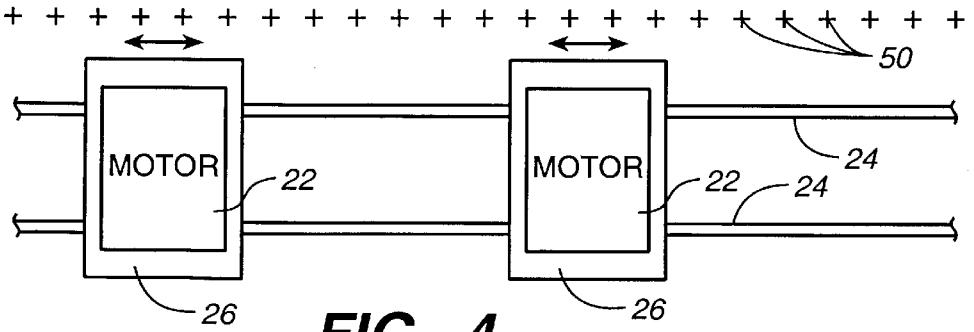
FIG. 4 is a top diagram illustrating the motors positioned on platforms which can be moved between different line set areas in the present invention.

FIG. 4 is a diagram illustrating rails 24, motors 22 and position 50 of the rigging elements. The motor 22 is placed on platform 26. The platforms 26 can be moved back and forth along rails 24 to different rigging positions. The system could use a number of mounted motors which could be randomly connected to the rigging elements to provide computerized control of the rigging elements. The motors could then be moved to a different set of rigging elements for a concurrent production.

The random motorized counterweight system has the advantage that it allows selective assignment of motors used. In addition, this type of system has the advantage that a large number of closely spaced rigging elements can be used.

Details of one embodiment of the present invention are described below. It is to be understood that this is just one way to implement the invention which can be implemented in a variety of different ways.

The hoist motors are sized to carry a working load of 1,000 pounds at a variable speed of 0 to 240 feet per minute. The motors have a minimum NEMA service factor of 1.25 for continuous operation. The brakes are an integral part of the motor and operate on a three-phase AC. The control components, including a flux vector drive control module, limit switches, load sensors and the like, are on board the winch unit and within the parameter of the frame. The drive control has a local up-down, forward-reverse and jog control on the face panel. The integral motor brake is normally closed, direct-acting spring-loaded, electrically-released and equipped with a manual release as well. The brakes hold 200 percent of the full load torque. Hoist gear boxes can have combination helical-worm reducers, directly mounted to a flange to a brake/motor combination. The gear reducers are selected to safely transmit the required power, torque and impact. The gear reducers have a minimum service factor of 1.5 and an AGMA load classification of 1. The gear reducer case can be made of a light tensile nickel cast iron. The helical gear are centrifugally cast bronze, mounted in a cast iron hub. The input and output shafts are supported by two tapered roller bearings. The gears run in an oil bath. The shaft bearings have a double lip oil seal to prevent leakage. The primary drive sprocket is hardened steel 6 inch diameter, 80 pitch. A flange hub is keyed to the output shaft of the gear box. The chain guard limit switch housing is mounted to the motor frame so that it is hinged away from the sprocket for direct access to the chain. The housing is a welded construction of ⅛th inch steel plate. The housing includes a chain keeper guard to surround the sprocket at least 160 degrees and fits close enough to prevent the chain from jumping the sprocket in use. The two lever-actuated microswitches serve as the ultimate hard limit of the system. One is located at each end of the extreme travel of the compensating chain. The digital encoder provides telemetry control to the master rigging control. The digital encoder is driven by a cogbelt from the output shaft to the gear box. The encoder also has programmed limits. The gear motor is mounted on a self-aligning tensioning base. The base is mounted to the drive unit via capture flanges that act as beam clamps. The base is a travelling mounting frame that moves the drive unit fore and aft allowing it to tension the drive chain. A manually-operated lead screw is used to control the movement of the mounting frame which will positively lock in the extended position. The tensioning base can be a Thompson Industries 2DA-16-00L Quick-slide with slight modifications.

The base rails are formed from 6 inch wide flange structural shapes. The rails are butt spliced and ground smooth for free travel of the motor drive unit. The base rails have a locator pin hole to align the drive unit with this chain center line with a quick pin fixing. The base rails are mounted on a structural slab with vibration isolation pads. The pads are no greater than 1'6" on center of the full length of the rails.

Various details of the implementation and method are merely illustrative of the invention. It will be understood that various changes in the details may be within the scope of the invention, which is to be eliminated only by the appending claims.

What is claimed is:

1. A system of motorized theatrical rigging, the system comprising:

a number of rigging elements, each rigging element including an overhead hanging device connected to cables that feed through at least one pulley and connect to a counterweight, and a control roller chain connected to the counterweight; and at least one motor, the at least one motor being arranged so that it can be connected and disconnected to the control chain, wherein there are fewer motors than rigging elements in the system and wherein the at least one motor is arranged so as to be connected to different rigging elements at different times.

2. The system of claim 1, wherein the at least one motor is positioned on a track.

3. The system of claim 2, wherein the track comprises rails on which a platform containing the at least one motor can be slid.

4. The system of claim 3, wherein multiple motors are positioned on multiple platforms on the rails.

5. The system of claim 3, wherein the platform contains a locking element to hold the platform in position.

6. The system of claim 1, wherein the hanging device includes a support element.

7. The system of claim 1, wherein the chain is attachable to a drive sprocket at the motor.

8. The system of claim 7, wherein the drive sprocket can be positioned to tension the chain.

9. The system of claim 1, wherein the control roller chain is arranged to balance the weight of the cables attached to the supporting member.

10. The system of claim 1, further comprising a logic control or computer system for automated control of the motor once attached to the control chain.

11. The system of claim 1, wherein when the motor chain is disconnected to the control roller chain, the rigging elements can be manually operated.

12. The system of claim 1, further comprising a tension sprocket for tensioning the control roller chain when the control roller chain is disconnected from the motor.

13. A system of theatrical rigging, the system comprising:

a number of rigging elements having control chains; and at least one motor, the at least one motor being connected to a support, the support being arranged on a track, wherein the at least one motor being arranged so that it can be connected and disconnected to one of the control chains of the rigging elements, wherein there are fewer motors than rigging elements in the system and the at least one motor can be moved on the track so as to connect to different rigging elements at different times.

14. The system of claim 13, wherein each rigging element including an overhead hanging device attached to cables that feed through at least one pulley and connect to a counterweight, and a control chain connected to the counterweight.

15. The system of claim 13, wherein the overhead hanging device includes a support element.

16. The system of claim 13, wherein the chain is attachable to a drive sprocket at the motor.

17. The system of claim 16, wherein the drive sprocket can be positioned to tension the chain.

18. The system of claim 13, wherein the control roller chain is arranged to balance the weight of the cables attached to the supporting member.

19. The system of claim 13, further comprising a logic control or computer system for automated control of the motor once attached to the control chain.

20. The system of claim 13, wherein when the motor chain is disconnected to the control roller chain, the rigging elements can be manually operated.

21. The system of claim 13, further comprising a tension sprocket for tensioning the control roller chain when the control roller chain is disconnected from the motor.

* * * * *

UNITED STATES PATENT AND TRADEMARK OFFICE

CERTIFICATE OF CORRECTION

PATENT NO. : 5,996,970
DATED : December 7, 1999
INVENTOR(S) : S. Leonard Auerbach It is certified that error appears in the above-identified patent and that said Letters Patent is hereby corrected as shown below:

Title page,
The title page, showing the illustrative figure, should be deleted to appear as per the attached title page.
Figure, at approximately line 35, replace:

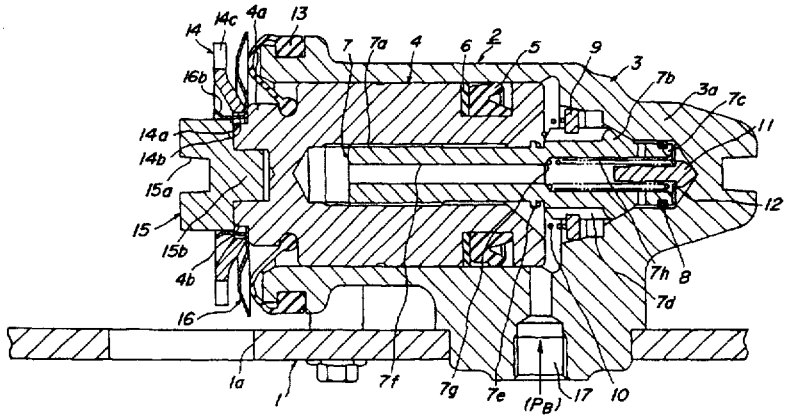

Signed and Sealed this

Fifth Day of March, 2002

*Attest:*

*Attesting Officer*

JAMES E. ROGAN
*Director of the United States Patent and Trademark Office*

United States Patent [19]

Auerbach

[11] Patent Number: 5,996,970

[45] Date of Patent: Dec. 7, 1999

[54] MOTORIZED ASSIST COUNTERWEIGHT SYSTEM FOR THEATRICAL OVERHEAD RIGGING

[76] Inventor: S. Leonard Auerbach, 3349 Pierce St., San Francisco, Calif. 94123

[21] Appl. No.: 09/104,554

[22] Filed: Jun. 25, 1998

[51] Int. Cl.[6] ..... B66D 1/26

[52] U.S. Cl. ..... 254/288; 254/280; 254/290; 254/393; 160/332; 472/78

[58] Field of Search ..... 254/275, 280, 254/282, 288, 289, 290, 372, 393, 397; 472/77, 78, 79, 80; 160/331, 332

[56] References Cited

U.S. PATENT DOCUMENTS

| | | | |
|---|---|---|---|
| 1,027,028 | 5/1912 | Bailey | 472/78 |
| 1,810,890 | 6/1931 | Allen | 472/78 |
| 3,345,066 | 10/1967 | Izenour | 472/78 |
| 3,370,639 | 2/1968 | Von Brimer | 160/331 |
| 3,429,298 | 2/1969 | Thomason | 160/331 |
| 3,986,703 | 10/1976 | Brett et al. | 472/78 |
| 4,606,527 | 8/1986 | Ziller et al. | 472/78 |
| 5,031,574 | 7/1991 | Medowell | 160/331 X |
| 5,790,407 | 8/1998 | Strickland et al. | 254/280 X |

FOREIGN PATENT DOCUMENTS

| | | | |
|---|---|---|---|
| 1133524 | 6/1960 | Germany | 254/275 |

*Primary Examiner*—Donald P. Walsh
*Assistant Examiner*—Emmanuel M. Marcelo
*Attorney, Agent, or Firm*—Majestic, Parsons, Siebert & Hsue P.C.

[57] ABSTRACT

In a theatrical rigging system, a number of motors can be placed on platforms which can move upon rails to be connected to different theatrical rigging elements. The motors can be randomly attached to operate different overhead hanging devices.

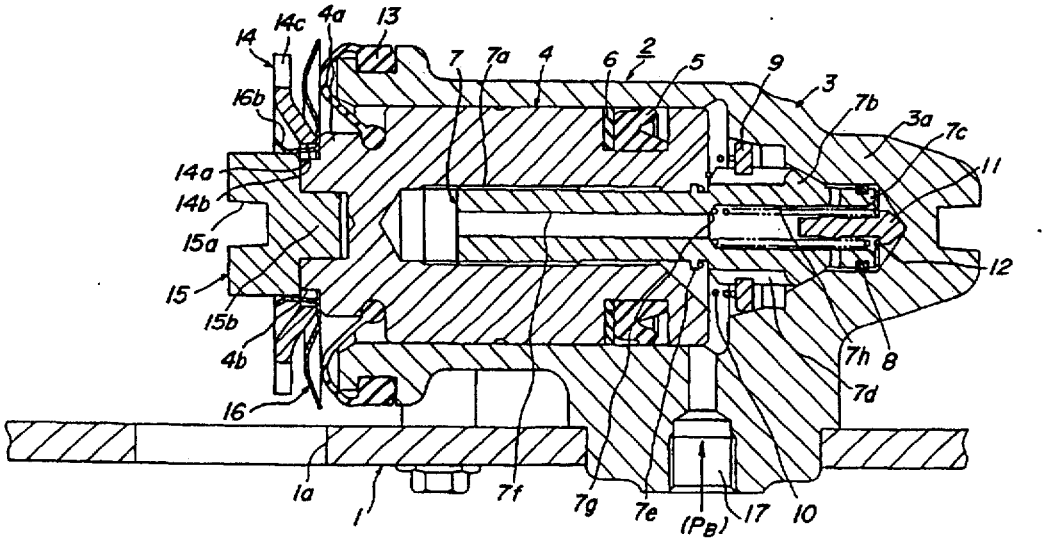

21 Claims, 4 Drawing Sheets